United States Patent [19]

Valenzona

[11] Patent Number: 4,985,605

[45] Date of Patent: Jan. 15, 1991

[54] COMPACT SWITCHING APPARATUS AND METHOD OF CONSTRUCTION

[75] Inventor: Joseph F. Valenzona, El Toro, Calif.

[73] Assignee: Judco Manufacturing, Incorporated, Harbor City, Calif.

[21] Appl. No.: 437,327

[22] Filed: Nov. 17, 1989

Related U.S. Application Data

[63] Continuation of Ser. No. 214,420, Jul. 1, 1988, abandoned.

[51] Int. Cl.[5] ..... H01H 13/58

[52] U.S. Cl. ..... 200/528; 200/526; 200/275; 200/341; 200/303; 200/276.1

[58] Field of Search ..... 29/622; 200/523, 526, 200/527, 528, 341, 293, 295–296, 303, 284, 294, 275, 530, 16 G, 276.1

[56] References Cited

U.S. PATENT DOCUMENTS

| | | | |
|---|---|---|---|
| 2,338,481 | 1/1944 | Batcheller | 200/276.1 X |
| 2,814,698 | 11/1957 | Miller, Sr. | 200/530 |
| 3,694,603 | 9/1972 | Congelliere et al. | 200/526 |
| 3,842,230 | 10/1974 | Kashio et al. | 200/276.1 X |
| 4,175,222 | 11/1979 | Buttner | 200/528 |
| 4,218,594 | 8/1980 | Komatsu et al. | 200/11 G |
| 4,225,764 | 9/1980 | Buttner | 200/526 X |
| 4,230,921 | 10/1980 | Wearing | 200/526 |
| 4,288,670 | 9/1981 | Buttner | 200/303 |
| 4,308,440 | 12/1981 | Buttner | 200/303 |
| 4,317,015 | 2/1982 | Buttner et al. | 200/526 |
| 4,319,106 | 3/1982 | Armitage | 200/526 |
| 4,340,793 | 7/1982 | Kirchoff | 200/284 X |
| 4,345,128 | 8/1982 | Buttner et al. | 200/526 |
| 4,506,124 | 3/1985 | Rose et al. | 200/528 |
| 4,771,141 | 9/1988 | Flumignan et al. | 200/528 |
| 4,891,476 | 1/1990 | Nation et al. | 200/527 X |

FOREIGN PATENT DOCUMENTS

| | | | |
|---|---|---|---|
| 2433997 | 2/1976 | Fed. Rep. of Germany | 200/528 |
| 2108318 | 5/1983 | United Kingdom | 200/295 |

*Primary Examiner*—Ernest G. Cusick
*Attorney, Agent, or Firm*—Kenneth W. Float

[57] ABSTRACT

An electromechanical spring-loaded switch having a plunger employed for actuating a ratchet mechanism against a biasing spring for rotatively driving a contact cup, the combination utilized for providing electrical contact with a common terminal and a plurality of output load terminals, each component of the switch having a miniaturized low-profile construction for minimizing the size of the switch which includes a plurality of slots fashioned into a top body portion and a bottom cover portion for receiving a plurality of corresponding mounting clips permitting convenient mounting of the switch directly to a mounting enclosure significantly improving the utility of the switch in electrical circuits.

13 Claims, 6 Drawing Sheets

FIG. 3.
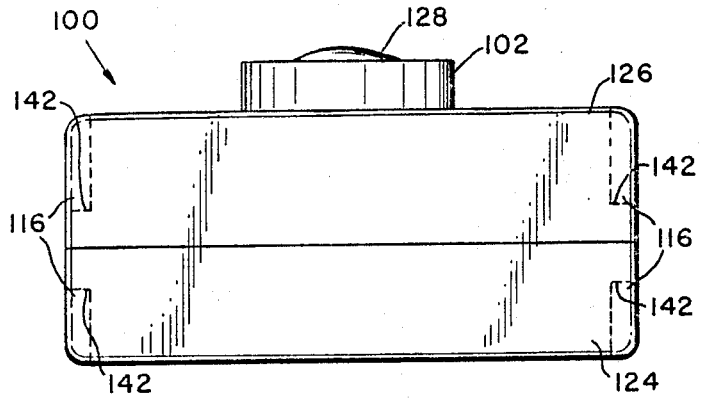
FIG. 4.
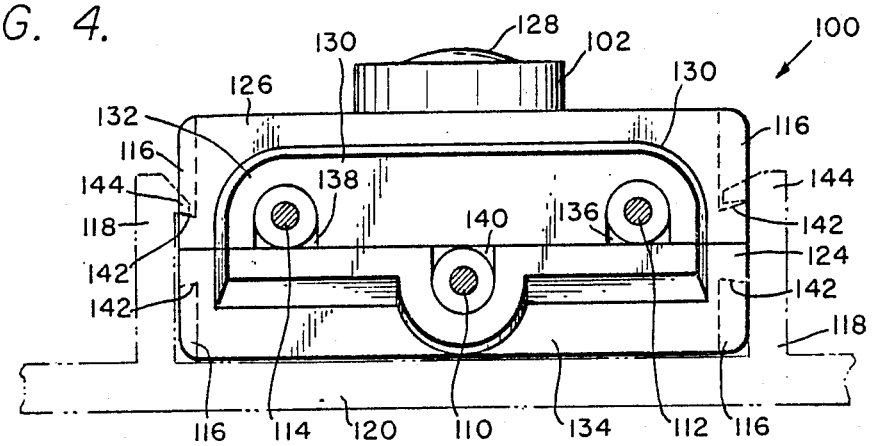
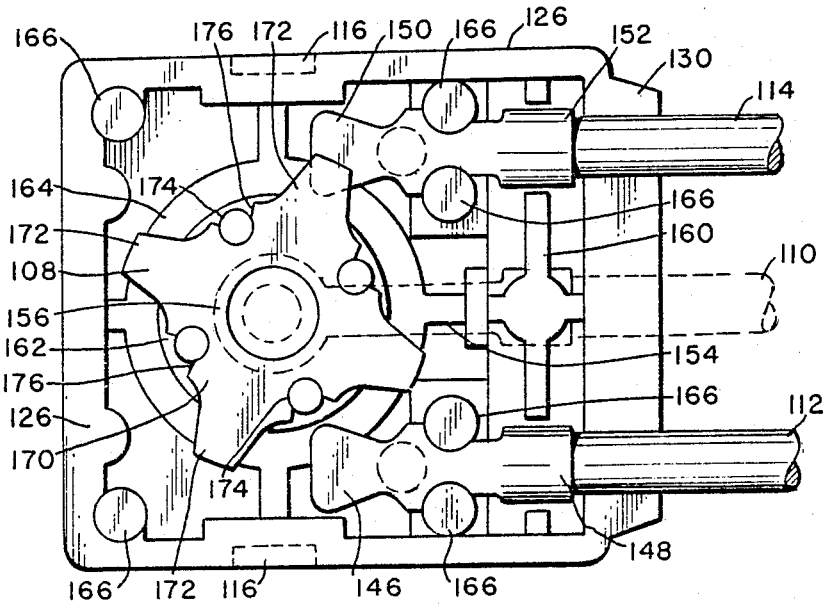
FIG. 5.

FIG. 7a.
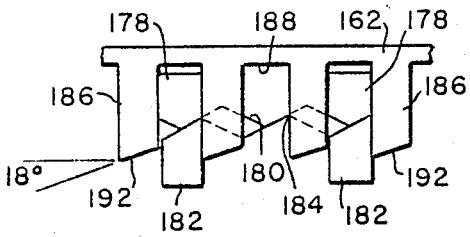
FIG. 7c.
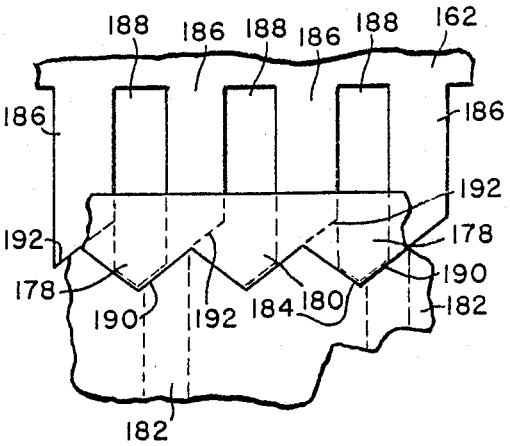
FIG. 7d.
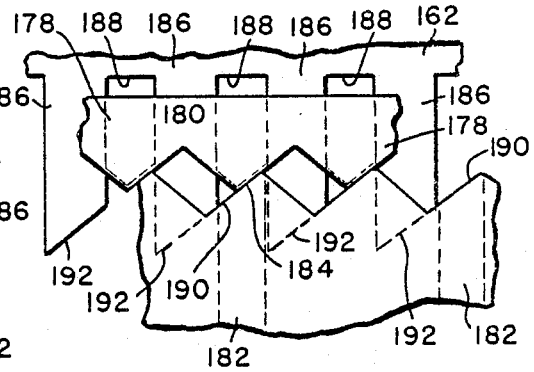
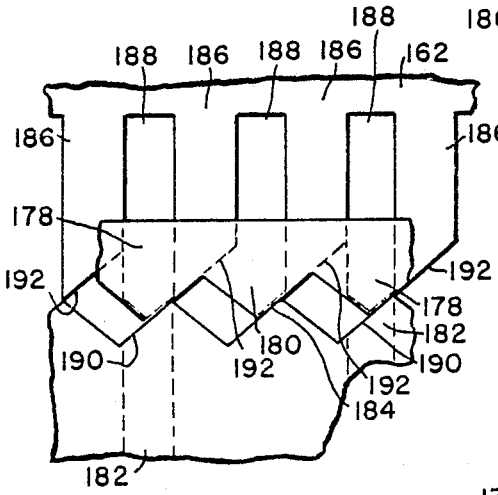
FIG. 7b.
FIG. 7e.
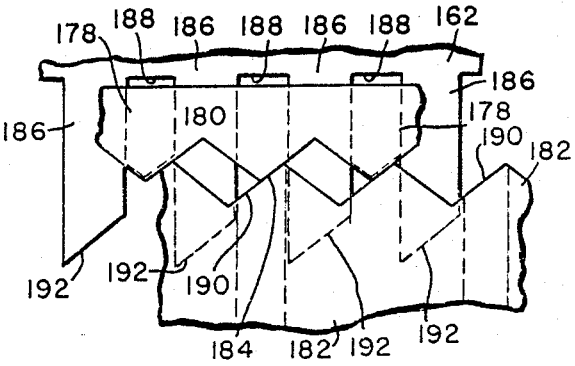

COMPACT SWITCHING APPARATUS AND METHOD OF CONSTRUCTION

This application is a continuation of application Ser. No. 214,420, filed July 1, 1988, now abandoned.

BACKGROUND OF THE INVENTION

This invention relates generally to electromechanical switching devices for use in electrical circuits, and more particularly, to a low-profile switching apparatus for use in limited space applications.

In the field of electromechanical switching devices, the use of spring-loaded rotating switches has been recgonized and accepted as an effective way to switch low voltage electrical circuits. Such switches are often employed in various applications in which space limitation is not entirely critical. Typically, the spring-loaded switches of the past have been relatively large requiring substantial space for mounting on a control panel or the like. Such switches of the past have included a body portion combined with a cover portion, the combination providing an outer shell for the spring-loaded switch. Such a switch also included a combination of contacts and terminals joined together to operate as a single unit. An example included a moving contact cup which included a biasing spring mounted within the volume of the contact cup. The biasing spring was employed for completing an electrical circuit between the contact cup and one or more input and output terminals. Additionally, the switch included a push button plunger in mechanical communication with a rotating ratchet mechanism. Both the plunger and the ratchet mechanism were cylindrical in shape with the internal volume of the plunger fashioned for receiving the ratchet mechanism therein.

The push button plunger extended through a cylindrical opening in the body portion of the switch of the prior art. The cylindrical opening or port included a plurality of splines formed in a vertical fashion within the port. Once the switch was assembled, a plurality of protuberances formed on the exterior surface of the plunger, would ride in the spaces between the splines along the inner vertical dimension of the port. Upon operation of the push button plunger, the ratchet mechanism was forced downward against the biasing spring. At the point of ratchet, each of a plurality of protuberances formed on the ratchet mechanism interacted with a ramp portion of each respective spline.

Once the ratchet mechanism passed the apex of the ramp located at the bottom of each spline, the sloped surface located on the top of the ratchet protuberance interfaced with the ramped surface of an individual spline permitting the ratchet protuberance to slide across the spline ramp. This action resulted in the ratchet mechanism rotating to the next adjacent space located between the plurality of splines. Once the ratchet mechanism adopted this posture, the upward force of the biasing spring drove the ratchet mechanism and the plunger to the upper limit of the space between the plurality of splines. Normally, the ratchet mechanism carried the contact cup therewith. Therefore, the operation of the ratchet mechanism caused the contact cup to move with the ratchet permitting the electrical circuit between the contact cup, the biasing spring and a plurality of terminals to be connected or disconnected.

Such an electromechanical switching device of the past was normally mounted upon a chassis by one of two methods. In a first method, part of the external surface or collar of the port through which the push button plunger extended was threaded. The threaded collar was normally passed through a preformed hole in a mounting plate for mating with a complementary threaded nut. Once the nut was threaded onto the collar, the push button switch was securely mounted to the mounting plate and was ready to be wired into the circuitry for control purposes.

A second method of mounting the electromechanical switches of the past included providing a locking ring along the collar of the port which the push button plunger extended through. Thus, a portion of the collar, between the base of the port and the locking ring was sized to be mated with a slot configured into a mounting plate. Installation of the switch in the mounting plate merely required manipulating the body and cover portions of the switch so that the space along the collar was received by the slot in the mounting plate.

Notwithstanding extensive utility, the electromechanical spring-loaded switching devices were not useful in certain limited space applications. Generally, the main problem was the size of the switching device. Certain limited space switching applications such as those existing in printed circuit boards or in miniature battery operated devices did not have sufficient space to employ the previously known electromechanical switches.

High density packaging of printed circuit boards requires that more hardware be fitted onto a single printed circuit board. Such a requirement limits the space dedicated for mounting a switching device and necessitates the development of miniaturized highly efficient current carrying switching devices. Additional examples also include applications in appliance and automotive products which limit the available space for mounting a switching device.

Hence, those concerned with the development and use of electromechanical spring-loaded switching devices in the product development field have long recognized the need for an electromechanical spring-loaded switching device comprised of a miniaturized low-profile switch having a design incorporating low-profile components capable of utilizing either lead-type or tab-type terminals, and including a mounting system suitable for such a low-profile switch while providing similar electrical ratings available in larger switches. The present invention fulfills all of these needs.

SUMMARY OF THE INVENTION

Briefly, and in general terms, the present invention provides a new and improved switch construction which substantially reduces the size of the switch, and which significantly increases the utility of electromechanical spring-loaded switches in limited space switching applications. Moreover, the switch construction of the present invention utilizes miniaturized low-profile components, provides a suitable mounting means and an optional selection of lead-type or tab-type terminals, is trouble free and reliable in use, and attains its improved result while providing similar electrical ratings available in larger switches.

Basically, the present invention is directed to an improved electromechanical switch and method of operation for reducing the size of the switch and for increasing the utility of electromechanical spring-loaded switches in limited space switching applications. This is accomplished by employing miniaturized low-profile components and by providing a suitable low-profile mounting means.

In accordance with the invention, a plunger, a ratchet mechanism and a contact cup ar upwardly biased within a top body portion by a helical spring which is directly in contact with a common input terminal in a bottom cover portion. Also, both the top body portion and the bottom cover portion include a plurality of slots for accommodating a plurality of mounting clips attached to a mounting enclosure. Each of these design features permit a slim, compact construction for increasing the utility of the switch in limited space applications.

In accordance with the improved method of the present invention, as the push button is actuated, the plunger, ratchet mechanism and contact cup are forced downward against spring pressure. As a plurality of protuberances of the plunger and ratchet mechanism ride in a plurality of spaces located between a plurality of splines formed in the top body portion, an inclined surface on each of the ratchet protuberances engages a ramped surface of each of the plurality of splines. The ratchet inclined surface rides down the spline ramp resulting in the ratchet mechanism rotating a fixed angular distance. A plurality of lobes extending from the contact cup rotate with the ratchet mechanism which is in permanent electrical communication with the common input terminal through the biasing spring. This action results in the connection and disconnection of at least a single electrical circuit.

Also, in the improved method, as the plurality of slots of the flat switching apparatus are aligned with the corresponding plurality of mounting clips extending from the mounting enclosure, the clips, being resilient, slide over the switch exterior and snap into the respective slots for locking the switching apparatus in position. Applying an outward lateral force to the clip permits release from the respective slot and removal of the switching apparatus from the enclosure.

The new and improved electromechanical switch and method of operation of the present invention substantially reduces the size of the switch by utilizing miniaturized low-profile components which significantly increases the utility of electromechanical spring-loaded switches in limited space applications. Also, the new and improved electromechanical switch provides a suitable mounting means by including the plurality of slots for interfacing with the resilient mounting clips, provides for the optional selection of lead-type or tab-type terminals, is trouble free and reliable in use, and attains its improved result by providing similar electrical ratings available in larger switches.

These and other features and advantages of the invention will become apparent from the following more detailed description, when taken in conjunction with the accompanying drawings, which illustrate, by way of example, the features of the invention.

BRIEF DESCRIPTION OF THE DRAWINGS

FIG. 3 is a first side elevational view of the flat switching apparatus of FIG. 1;

FIG. 4 is a second side elevational view of the flat switching apparatus of FIG. 1;

FIG. 5 is a bottom planar view of a top body portion of the flat switching apparatus of FIG. 1;

FIG. 7(*a*)- 7(*e*) is a sequence of fragmentary sectional views of a ratchet mechanism taken along line 7—7 of FIG. 6;

DETAILED DESCRIPTION OF THE PREFERRED EMBODIMENT

Figure 1:
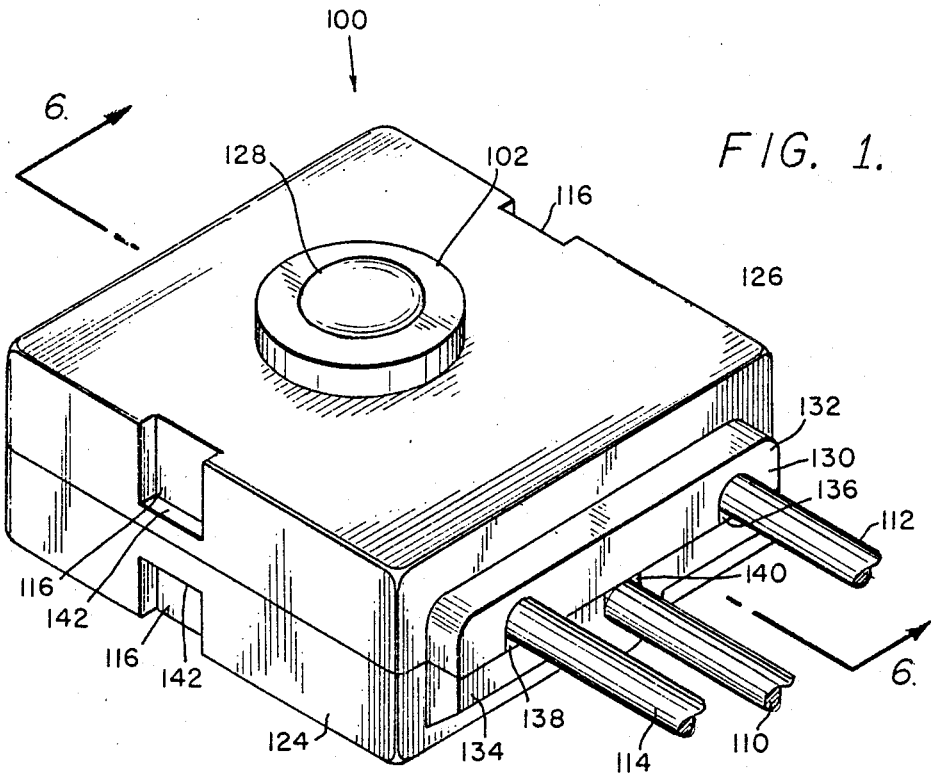
FIG. 1 is a perspective view of a flat switching apparatus in accordance with the present invention.
Figure 2:
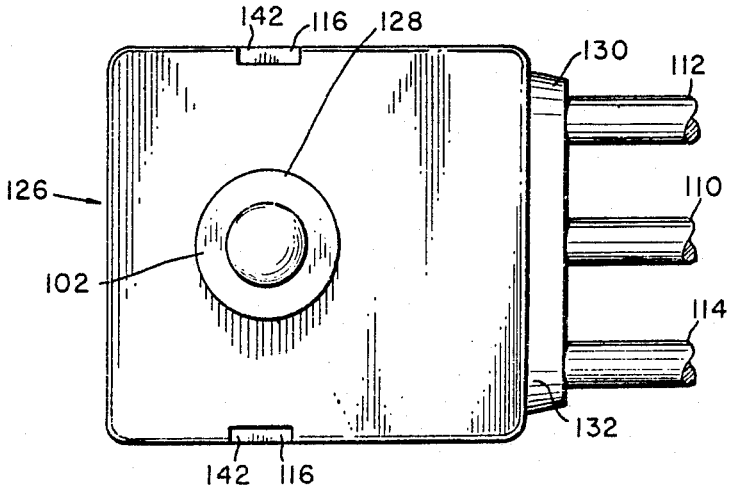
FIG. 2 is a top planar view of a top body portion of the flat switching apparatus of FIG. 1.

As shown in the drawings for purposes of illustration, the invention is embodied in a single-pole double-throw electromechanical switch 100 of the type having a spring-loaded plunger 102 employed for actuating a ratchet mechanism 104 against a biasing spring 106 for rotatively driving a contact cup 108, the combination utilized for providing electrical contact between a common input terminal lead 110 and up to two output load terminal leads 112, 114. Each component is of a miniaturized low-profile construction for minimizing the size of the switch 100 which includes a plurality of slots 116 for receiving a plurality of mounting clips 118 attached to a mounting enclosure 120.

The utilization of electromechanical spring-loaded switching devices have in the past been recognized and accepted as an effective way to switch electrical circuits Such switching devices are often employed in various applications in which space limitation is less of a critical factor. Typically, the electromagnetic spring-loaded switches of the past have included a combination of a top body portion that mechanically communicates with a bottom cover portion having a port extending through the top body portion. A spring loaded plunger extends through the port and is employed for actuating a ratchet mechanism which drives a conductive contacting cup for communicating with an electrical input terminal through a biasing spring.

Normally, the input electrical terminal includes an electrical connector which is attached to the top of a center post rising from the base of the bottom cover portion. The biasing spring normally communicates with the input terminal at the top of the center post resulting in a much larger and bulkier switch construction. Additionally, spring-loaded electromechanical switches of the past have included a threaded collar located above that part of the top body portion which forms the port. The threaded collar was normally employed for penetrating through a preformed hole existing in a mounting plate and for receiving a complementary threaded nut for securing the electromechanical switch to the mounting plate. In the alternative, the collar could be fashioned to include a locking ring, the diameter of which was greater than the collar. Then, a mounting plate was fashioned to include a congruent slot configured for snuggly receiving that portion of the collar located between the locking ring and the top body portion.

Because of the larger internal components and structural mounting design, the electromechanical switches of the past were too large for a plurality of limited space applications. Examples of such applications included printed circuit boards employing high density packaging designed to increase the number of electronic components mounted thereon. Such high density packaging necessitates a smaller switching device. Other applications include household and hand-held appliances, and automotive control and lighting electrical circuits which are, likewise, space limited requiring a smaller switch.

In accordance with the present invention, the low-profile construction of the plunger 102, the ratchet mechanism 104, and the contact cup 108 cooperate with the biasing spring 106 which is in contact with the common terminal lead 110 at the base of a well 122 within a bottom cover portion 124 for reducing the size of the switch 100 and for significantly increasing the utility of the electromechanical switch in limited space applications. Further, the switch 100 provides the plurality of slots 116 in both the bottom cover portion 124 and in a top body portion 126 for cooperating with each respective mounting clip 118 for securing the switch on the mounting enclosure 120. Also, the switch provides for the optional selection of lead-type or tab-type connectors for the common terminal lead 110 and the load terminal leads 112, 114, and attains the improved results while providing similar electrical ratings available in larger switches.

The switching mechanism of the electromechanical switch 100 is comprised of a single pole, double throw switch which is normally connected to the common input terminal lead 110 on the input side and first and second load terminal leads 112, 114 on the output side. Each of the load terminal leads can be connected to separate electrical loads so that one of the connected loads is energized at all times as is shown in FIG. 1. Note that either the first load terminal lead 112 or the second load terminal lead 114 may be removed for providing a single pole, single throw switching device.

Figure 6:
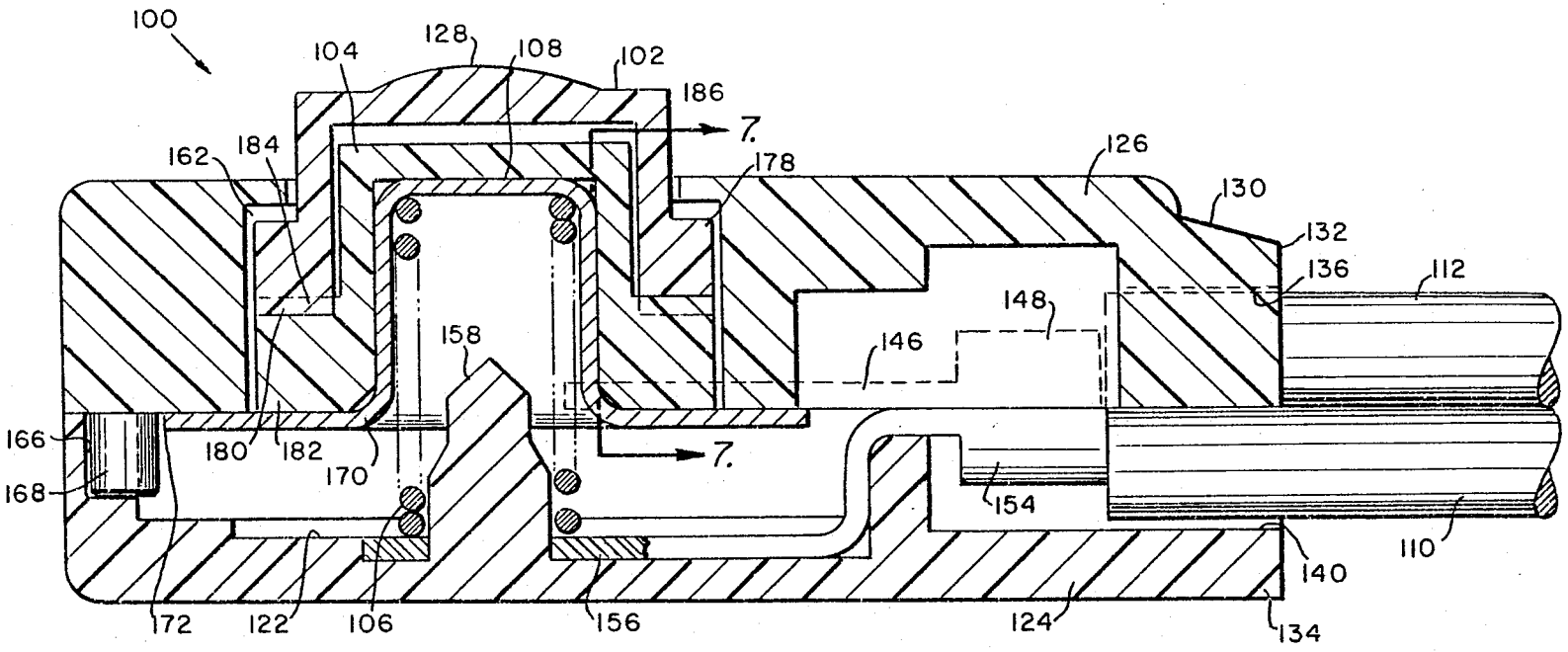
FIG. 6 is a cross-sectional view of the flat switching apparatus taken along line 6—6 of FIG. 1.
Figure 8:
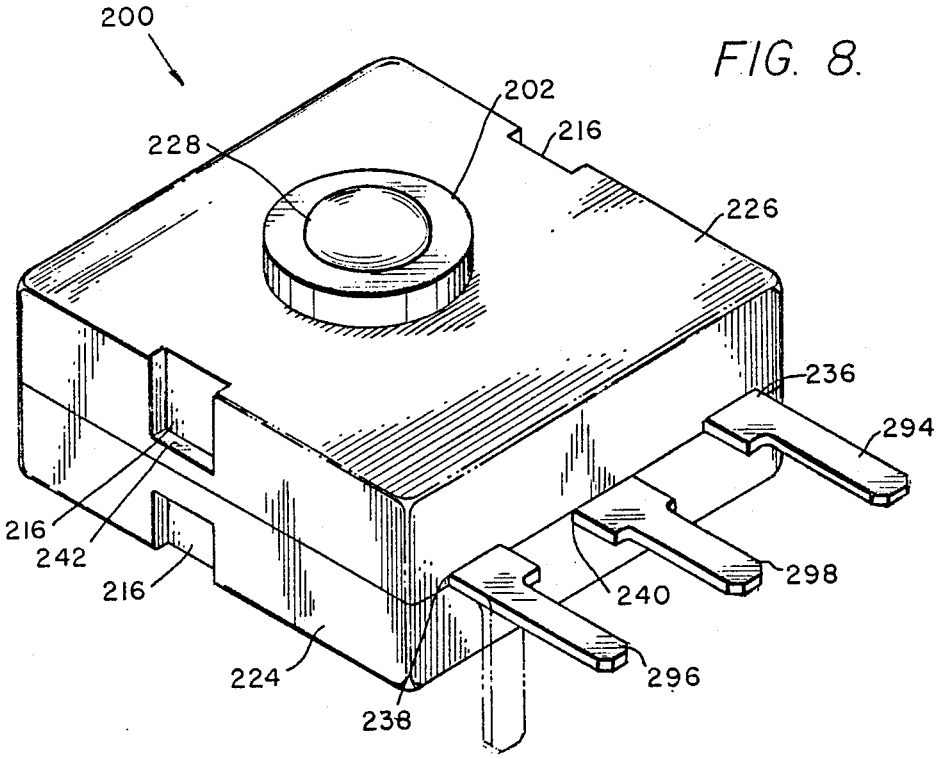
FIG. 8 is a perspective view of an alternative embodiment of a flat switching apparatus of the present invention.
Figure 9:
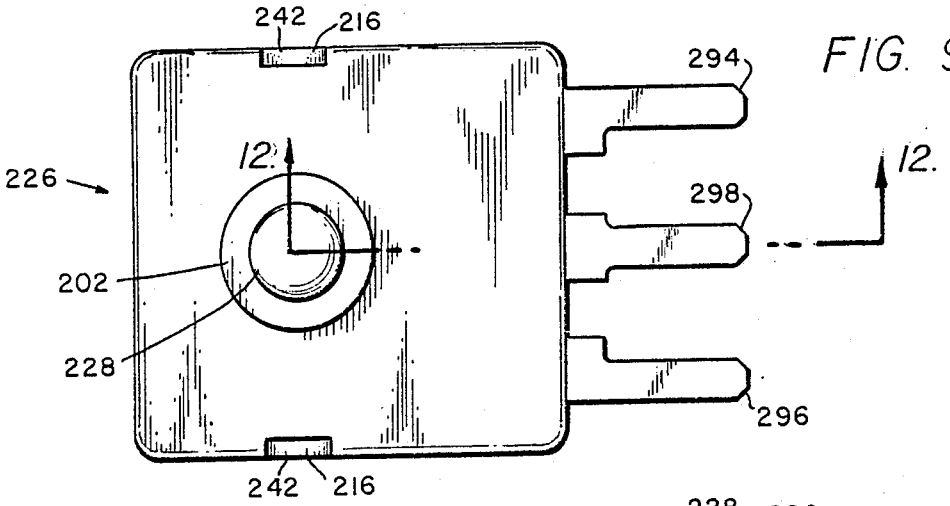
FIG. 9 is a top planar view of a top body portion of the flat switching apparatus of FIG. 8.

The bottom cover portion 124 houses the switching mechanism while the top body portion 126 mates with and is securely held to the bottom cover portion by utilizing a post and hole interference fit as is shown in FIG. 6. The top of the plunger 102 terminates in a bead 128 which in integral with the spring-loaded plunger and which provides for a convenient point for actuating the plunger. Additionally, a hood 130 includes a top hood section 132 formed integral with the top body portion 126 and bottom hood section 134 formed integrally with the bottom cover portion 124 as shown in FIG. 1. The top hood section 132 includes a pair of upper preformed penetrations 136, 138 for accommodating the first load terminal lead 112 and the second load terminal lead 114, respectively.

Likewise, the common input terminal lead 110 is accommodated by a lower preformed penetration 140 with each of the penetrations being circular in nature as is illustrated in FIGS. 1 and 4. It is clearly shown that the upper preformed penetrations and the lower preformed penetration provide a pathway for the first and second load terminal leads and the common input terminal lead directly into the switching mechanism for making contact with the biasing spring 106 and the contact cup 108 as is illustrated in FIG. 5.

The plurality of slots 116 are formed in those sides of both the bottom cover portion 124 and the top body portion 126 which are immediately adjacent to the side of the switch having the integral hood 130 formed thereon. Note that each slot includes a shelf 142 which is designed for receiving one of the plurality of mounting clips 118 best shown in FIG. 4.

Often, the mounting enclosure 120 is comprised of plastic or a light gauge metal each of which includes the plurality of mounting clips 118 which are vertically mounted and terminating in a cantilever tab hook 144. The flexibility of the mounting clips 118 permits the electromechanical switch 100 to be inserted onto the mounting enclosure 120 by aligning the plurality of slots 116 with the cantilever tab hook 144. Upon forcing the switch down upon the mounting clips, the cantilever tab hooks expand to receive the switch thereafter engaging the shelf 142 of each slot 116. The switch is then securely mounted on the enclosure 120.

On some electronic or automotive applications, switching devices and components may be required to be mounted in various positions. Therefore, a set of slots 116 has been provided in both the top body portion and the bottom cover portion to accommodate various mounting conditions. When the switch is mounted so that the bottom cover portion 124 is adjacent to the mounting enclosure 120, the slots 116 formed in the top body portion 126 receive the hooks 144 of the mounting clips 118 as is clearly shown in FIG. 4. This mounting method is referred to as "downloading". Conversely, when the top body portion 126 is mounted adjacent to the mounting enclosure 120, the hooks 144 of the mounting clips 118 are received by the plurality of slots 116 formed in the bottom cover portion 124. This mounting procedure is referred to as "uploading". In essence, the switch may be inverted and still mounted to the enclosure 120 in the uploading procedure which would require modification to the enclosure from that shown in FIG. 4.

If after the switch 100 has been assembled the bottom cover portion 124 is removed, the contact cup 108 is visible as shown in FIG. 5. Also shown is a first terminal contact 146 having a first terminal connector 148 for connecting the terminal lead 112 to the contact cup. Additionally, a second terminal contact 150 having a second terminal connector 152 is attached thereto for connecting the terminal lead 114 to the contact cup. Also, a common terminal 154 is utilized for connecting the common input terminal lead 110 to a ring connector 156 which is mounted over a center post 158 within the well 122 (see FIG. 6). The ring connector 156 is passed over the center post 158 in the same manner as the biasing spring 106. Note that the ring connector and the biasing spring are in constant direct electrical contact at the very bottom of the well 122 of the cover portion 124. This feature illustrates one of the many unique features which makes possible the low profile construction of the present invention and further insures that the common terminal 154 is always connected to either the first terminal contact 146 or the second terminal contact 150 in the single pole, double throw switch.

Note that if either the first terminal contact 146 or the second terminal contact 150 were removed, the single pole, double throw switch would be reduced to a single pole, single throw switch. The bottom side of the top body portion 126 is molded in such a fashion as to support the various electrical components mounted therein. A rib 160 is provided in the top body designed for supporting the common terminal 154. Passing completely through the top body portion 126 is a port 162 for housing the plunger 102, the ratchet mechanism 104 and the contact cup 108. A supporting ring 164 is formed on the bottom side of the top body portion 126 for providing structural support to the port 162. Also, a plurality of posts 166 are integrally molded to and extend from the bottom side of the top body portion 126 for being received by a plurality of holes 168 for securing the top body portion 126 to the bottom cover portion 124 in a post and hole interference fit (best shown in FIGS. 5 and 6).

The contact cup 108 is comprised of a right circular cylindrical shape which fits into a hollow interior of the ratchet mechanism 104. Further, the contact cup includes a hollow interior designed for mounting the biasing spring 106 therein. The contact cup flares out into a base plane 170 for forming a plurality of lobes 172. The biasing spring 106 provides a constant upward force against the contact cup 108 which is mounted directly over the center post 158 as is shown in FIG. 6. The function of the contact cup 108 is to rotate with the ratchet mechanism 104 upon each actuation of the plunger 102 described hereinafter. The bottom portion of the ratchet mechanism 104 includes a plurality of extension studs 174 which mate with a corresponding plurality of recesses 176 formed in the base plane 170 of the contact cup 108. Therefore, as the ratchet mechanism is rotatively driven upon actuation of the plunger, the extension studs 174 securely mounted in the plurality of recesses 176 cause the contact cup 108 to be carried therewith.

The contact cup 108 is rotated forty-five mechanical degrees with every actuation of the plunger 102. Therefore, the design of the plunger and ratchet mechanism causes each lobe 172 of the contact cup 108 to rotate a sufficient number of mechanical degrees to break electrical contact with, for example, the second terminal contact 150 while completing electrical contact with the first terminal contact 146 with a single actuation of the switch as is illustrated in FIG. 5.

Because the common terminal 154 is always connected to the contact cup 108 through the ring connector 156 and the biasing spring 106, the position of the lobes 172 of the contact cup determine which electrical circuit connected to the switch 100 is energized. If either of the load terminal leads 112, 114 are removed, the switch becomes a simple on/off switch for a single electrical load with the ratchet mechanism carrying the cup in a rotatively fashion as the plunger is operated. Therefore, an additional distinguishing feature of the instant invention is the multilobe contact cup which provides for the alternately connecting and disconnecting of the switch to the pair of external circuits.

The combination of the plunger 102, the ratchet mechanism 104, the contact cup 108 and the biasing spring 106 is best illustrated in FIG. 6. It can be seen that each of these components exhibits a shape in the form of a right circular cylinder. Therefore, the plunger and the ratchet mechanism are each cylindrical in nature having a closed top portion and a hollow interior. Each of the components is staggered in its internal diameter so that the contact cup 108 may be fitted within the volume of the ratchet mechanism 104 which, in turn, is fitted into the volume of the plunger 102. Likewise, the biasing spring 106 is fitted into the contact cup and over the center post 158 of the well 122.

The plunger 102 includes a plurality of protuberances 178 distributed one per quadrant about the bottom external surface of the plunger. Between each protuberance, there exist a singular downward extending tooth 180 formed at the bottom of the plunger. Likewise, the ratchet mechanism 104 includes a plurality of protuberances 182 distributed one per quadrant and including a singular upward extending tooth 184 for meshing with the downward extending tooth 180 of the plunger.

The top body portion 126 includes the port 162 formed in a vertical circular cylinder and having a plurality of vertical splines 186 formed therein with a space 188 located between each adjacent spline as is shown in FIGS. 7(*a*)-7(*e*). Note that each of the plurality of protuberances 182 of the ratchet mechanism 104 includes an incline surface 190 while the bottom end of each of the plurality of vertical splines 186 includes a ramp surface 192 which forms, for example, an 18° angular surface which is complementary to the incline surface 190 of the ratchet protuberances 182.

The operation of the ratchet mechanism 104 will now be described with reference to the sequence of drawings of FIGS. 7(*a*)-7(*e*). When the plunger 102 is pushed downward, the plurality of plunger protuberances 178 partially engage and force downward the plurality of ratchet protuberances 182 against the biasing spring 106. The ratchet mechanism 104 is forced downward until it engages the complementary ramp surface 192 on the next adjacent vertical spline 186 within the port 162 as described hereinafter. The plurality of ratchet protuberances 182 mates with and slides down the ramp surface 192 into the next space 188 located between the adjacent splines. The upward force of the biasing spring urges the plurality of ratchet protuberances 182 upward into the next space 188 resulting in the rotation of the entire ratchet mechanism. Because the plurality of recesses 176 of the contact cup 108 receives the plurality of ratchet extension studs 174, the contact cup is forced to rotate with the ratchet mechanism.

Note that the plunger 102 does not rotate because the plurality of plunger protuberances 178 are locked within the corresponding spaces 188 located between the plurality of vertical splines 186. Also, it should be noted that although the plunger 102 and the ratchet mechanism 104 are biased one into the other by the biasing spring 106, the plurality of ratchet protuberances 182 are only partially engaged with the plurality of plunger protuberances 178.

During the operation of the ratchet mechanism 104, two rotation events occur. While the switch is in the steady state condition, the plunger protuberances 178 are not fully meshed with the ratchet protuberances 182 as shown in FIG. 7*a*. As the plunger is depressed, the ratchet mechanism and the corresponding ratchet protuberances move downward so that the incline surface 190 located at the top of each ratchet protuberance 182 approaches the ramp surface 192 at the bottom of the vertical splines 186 (see FIGS. 7*b* and 7*c*). Once the individual ratchet protuberances are forced downward beyond the apex of the spline ramp surface 192, the plunger protuberances and the ratchet protuberances are fully engaged. At this point, the ratchet protuberances being upwardly biased by the spring 106, engage the ramp surface 192 at the bottom of the particular vertical spline 186. The engagement initiates the movement of the incline surface of the ratchet protuberance down the ramp surface of the vertical spline.

The first rotation event occurs when the ratchet protuberances 182 passes the apex of the ramp surface 192 causing the incline surface 190 to engage the ramp surface 192 as is illustrated in FIG. 7*c*. After the plunger 102 is released, the ratchet protuberance 182 continues to slide down the ramp surface 192 which results in the second rotation event. Both the first and the second rotation events are necessary for completing a full cycle of the switch which is clearly illustrated in FIGS. 7c and 7d. Once the incline surface 190 has completely passed the ramp surface 192, the ratchet protuberance 182 is forced into the next space 188 by the biasing spring 106 which is illustrated in FIG. 7d. Upon completion of the cycle, the ratchet protuberence 182 comes to rest and is partially engaged with the plunger protuberance 178 as is shown in FIG. 7e. The complete cycle including the two rotation events results in a total rotation of the contact cup 108 of forty-five mechanical degrees.

It should be noted that the very top of the space 188 located above the plunger 102 and between the plurality of vertical splines 186 remains empty throughout the ratchet sequence shown in FIGS. 7a–7e. The purpose of this construction is for the following reasons. The first terminal contact 146 and the second terminal contact 150 are fixed in position. As the contact cup 108 is rotated by the ratchet mechanism 104 causing the second terminal contact 150 to communicate with the contact cup, the electrical load connected to the load terminal lead 114 is energized. The lobe 172 of the contact cup 108 is actually resting underneath the second terminal contact 150 as is illustrated in FIG. 5. In this posture, the biasing spring 106 provides an upward biasing force on the contact cup through the ratchet mechanism and the plunger.

That portion of the space 188 located above the plunger protuberance 178 is created because the lobe 172 of the contact cup 108 is captured beneath the second terminal contact when energized as shown in FIG. 5. Therefore, upon an additional actuation of the plunger, the captured lobe 172 is released resulting in the biasing spring driving the plunger to the top of the limit of the space 188. Therefore, the purpose of that portion of the space 188 is to ensure adequate contact force between, for example, the second terminal contact 150 and the lobe 172. If the top portion of the space 188 was not available, the biasing spring 106 which provides the contact force between the second terminal contact and the lobe would be pushing on the wall of the port 162.

Under these conditions, the contact force between the second terminal contact and the lobe would be inadequate for providing good electrical conduction. Because the single pole, double-throw switch includes the first terminal contact 146 in addition to the second terminal contact 150, the portion of space 188 above the plunger protuberances 178 always exist. However, in the single pole, single throw switch, the portion of space 188 exists only when the switch 100 is in the "on-position". When the switch assumes the "off-position", the the plunger 102 travels to the very top of the space 188.

Because each individual actuation of the switch results in a rotation of the contact cup of forty-five mechanical degrees, an additional actuation of the plunger causes another lobe 172 of the contact cup to engage the first terminal contact 146 energizing an electrical load connected to the load terminal lead 112. Because of the arrangement of the lobes 172 and the angular rotation of the contact cup with each actuation of the plunger, electrical energy may be alternately supplied to the two separate loads of the single pole, double throw switch.

The completion of the electrical circuit may be traced from the common input terminal 110 to the ring connector 156 which electrically communicates with the biasing spring 106. The biasing spring is in contact with the contact cup 108, the plurality of lobes 172 of which alternately contact either the first terminal contact 146 or the second terminal contact 150 as shown in FIG. 5. Furthermore, each of the electrical components is comprised of a highly conductive metal or metallic alloy as is known in the art for improving the efficiency of conduction.

The low profile construction of the switch 100 in which the biasing spring 106 is seated around the center post 158 at the base of the well 122 and which incorporates the miniaturized components, permits the reduced switch size to be realized and increases the utility of electromechanical switches. Notwithstanding the reduced size, the switch 100 of the present invention is capable of carrying in excess of two amperes of direct or alternating current at voltage ratings of from low direct current voltage levels to 125 volts AC.

An alternative embodiment for the present invention illustrated by the general reference character 200 will now be described. In this instance, the switch illustrated in FIGS. 8-12 also is of the electromechanical spring-loaded type somewhat similar to the switch illustrated in FIGS. 1–7. Those parts of the switch illustrated in FIGS. 8–12 which find substantial correspondence in structure and function to those parts illustrated in FIGS. 1–7 are designated with corresponding numerals of the 200 series.

Each of the structural elements of the electromechanical switch 200 illustrated in FIG. 8–12 are essentially duplicate to those components illustrated in the preferred embodiment of the switch 100 illustrated in FIGS. 1–7. However, a feature distinguishing the preferred embodiment 100 from the alternative embodiment 200 is the design of the terminal leads as is clearly illustrated in each of the drawing figures of the alternative embodiment.

Figure 10:
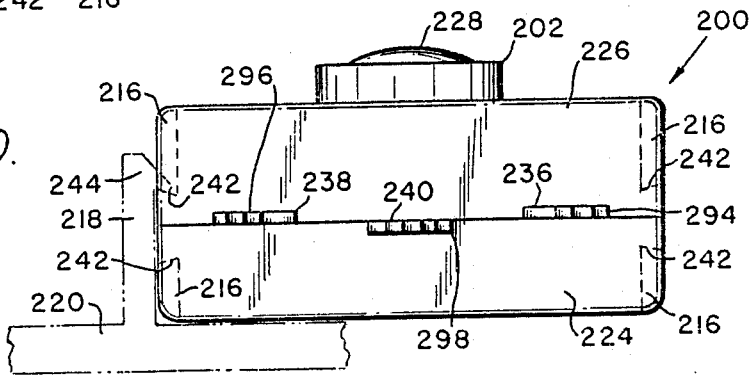
FIG. 10 is a side elevational view of the flat switching apparatus of FIG. 8.

It should be noted that a plunger 202, a ratchet mechanism 204, a biasing spring 206, and a contact cup 208 each operate as previously described. Further, the mounting system of the low profile switch 200 includes a plurality of resilient mounting clips each of which capture one of a plurality of slots 216 as is illustrated in FIG. 10. Further, the operation of the ratchet mechanism 204 as described with reference to the preferred embodiment of the switch 100 operates in exactly the same manner in the switch 200.

The switch 200 includes a plurality of terminal connectors of the tab-type which may be employed, for example, in printed circuit board mounting applications and further in quick-disconnect applications. Reminiscent of the preferred embodiment, a first upper preformed penetration 236 formed in the top body portion 226 accommodates a first load terminal 294 while a second upper preformed penetration 238, also formed in the top body portion, accommodates a second load terminal 296. Additionally, a lower preformed penetration 240 accommodates a common input terminal 298 best shown in FIG. 10. The terminals 294, 296, 298 are each male connectors and may be designed to extend straight out from the switch 200 for direct connection to an electrical circuit. In the alternative, the terminals may be orientated in an orthogonal manner for connection to a custom designed mounting enclosure 220, which may be found on a printed circuit board. It is noted that the hood construction 130 which was present in the preferred embodiment is absent in the alternative embodiment of the switch 200.

Figure 11:
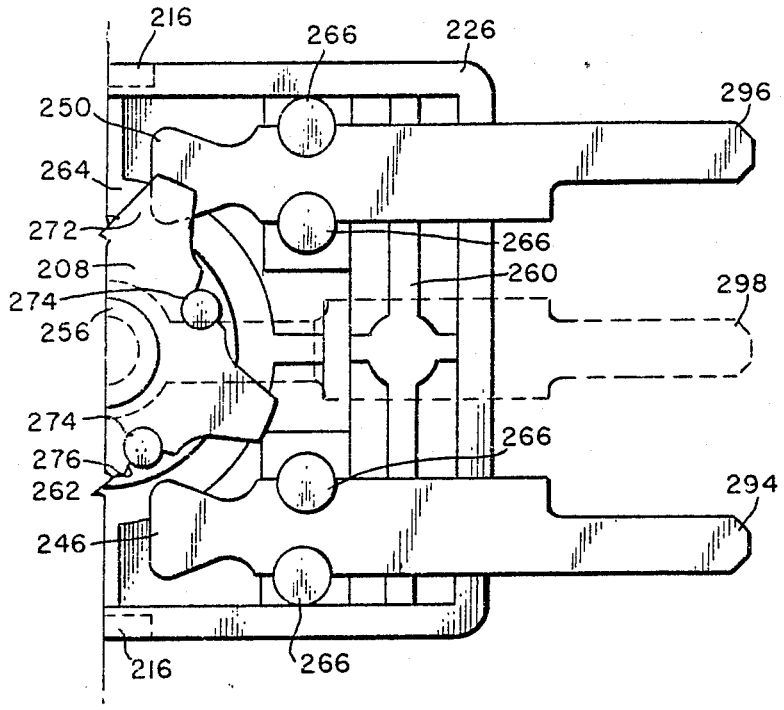
FIG. 11 is a partial bottom planar view of a top body portion of the flat switching apparatus of FIG. 8.
Figure 12:
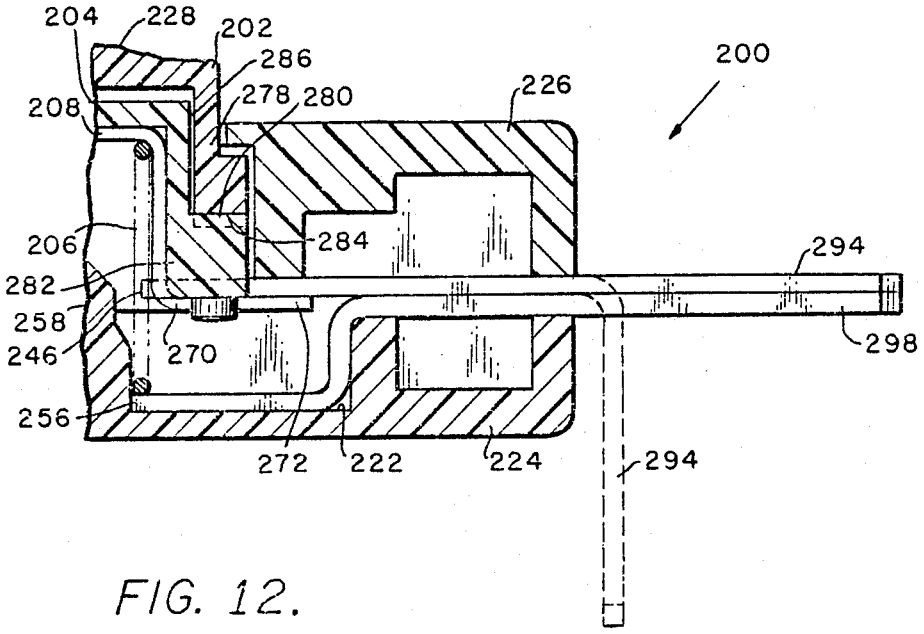
FIG. 12 is a partial cross-sectional view of the flat switching apparatus of FIG. 8 taken along the line 12—12 of FIG. 9.

Upon further inspection, it will be noted that the first load terminal 294 is continuous with a first terminal contact 246 which makes alternating electrical contact with a lobe 272 of the rotating contact cup 208. Further, the second lobe terminal 296 is directly connected to a second terminal contact 250 which also makes alternating contact with one of the plurality of lobes 272. Note that the first and second terminal connectors which were present in the switch 100 are absent from the alternative embodiment 200. This is the case because the tab-type terminal will be continuous with the terminal contacts 246, 250 as is shown in FIG. 11. Likewise, the common input terminal 298 is continuous with a ring connector 256 which is mounted around the center post 258 rising from the base of the well 222 of the bottom cover portion 224.

The addition of the tab-type terminals in combination with the low profile construction and the miniaturized components employed in the electromechanical switch 200, contribute to the reduction in the switch size and further improve the utility of the switch 200 for use in limited space applications.

From the foregoing, it will be appreciated that the electromechanical spring-loaded switch 100 of the present invention substantially reduces the size of the switch by employing miniaturized low-profile components and significantly increases the utility of the switch in limited space applications such as on printed circuit boards as, for example, in automotive electronics and lighting, and in consumer appliances such as miniature electrical lighting systems. Further, the invention provides a suitable mounting system by incorporating the slots 116 directly into the body and cover portions which permits the switch to be conveniently mounted directly to a printed circuit board, provides for the optional selection of lead-type terminals for permanent connections or of tab-type terminals for quick disconnect applications, and attains the reliable and improved results while providing similar electrical ratings available in larger switchs.

While several particular forms of the invention have been illustrated and described, it will be apparent that various modifications can be made without departing from the spirit and scope of the invention. Accordingly it is not intended that the invention be limited, except as by the appended claims.

I claim:

1. A compact switching apparatus for connecting and disconnecting an electrical circuit, comprising:

a housing defined by a top body portion and a bottom cover portion having an inner surface;

a first electrical terminal terminating on the inner surface of the bottom cover portion of said housing;

a second electrical terminal terminating within the top body portion of said housing;

an electrically conductive contact cup rotatably disposed within said housing in electrical contact with said second electrical terminal only when in a predefined rotational orientation, said contact cup having at least one recess provided therein;

an electrically conductive spring in compression between said conductive contact cup and said first electrical terminal said spring causing said contact cup to be in electrical communication with said first electrical terminal;

a plunger slidably mounted and projecting from said top body portion of said housing; and ratchet means coupled to said plunger and having at least one extension member disposed thereon coupled to said at least one recess provided in said contact cup to lock the ratchet means and contact cup together for converting depression of said plunger into a preselected amount of rotation of said contact cup.

2. The compact switching apparatus of claim 1 wherein said contact cup comprises a metallic cylinder having an outwardly radiating lobe extending therefrom which contacts said second electrical terminal when it is at said predefined rotational orientation.

3. The compact switching apparatus of claim 2 wherein said ratchet means comprises a rotary ratchet mechanism further comprising:

a plurality of splines in a cylindrical configuration arranged within the top portion of said housing, each spline terminating at its bottom in a ramped surface angling downwardly and along the circumference of said cylindrical configuration at an angle of approximately 18°;

a plurality of plunger protuberances, attached to and radiating outwardly from said plunger, each plunger protuberance being configured to reside in between adjacent splines and each plunger protuberance terminating at its bottom in a ramped surface in parallel with the ramped surface of each spline;

a ratchet of cylindrical cross section having radially extending ratchet protuberances, each ratchet protuberance being configured to reside in between adjacent splines and each ratchet protuberance terminating at its top in a ramped surface in parallel with the ramped surface of each spline.

4. The switching apparatus of claim 3 wherein said top body portion is secured to said bottom cover portion by means of a post and hole interference fit.

5. The switching apparatus of claim 3 wherein said top body portion and said bottom cover portion are each comprised of an electrical insulating material.

6. The switching apparatus of claim 3 wherein said body portion comprises a plurality of posts and said cover portion comprises a plurality of corresponding holes adapted to secure said body portion to said cover portion by a post and hole interference fit.

7. The switching apparatus of claim 2 wherein said operating means comprises a rotary ratchet mechanism comprising:

a plurality of splines in a cylindrical configuration arranged within the top portion of said housing, each spline terminating at its bottom in a ramped surface angling downwardly and along the circumference of said cylindrical configuration at an angle of approximately 18°;

a plurality of plunger protuberances attached to and radiating outwardly from said plunger, each plunger protuberance being configured to reside between adjacent splines, and each plunger protuberance terminating at its bottom in a ramped surface in parallel with the ramped surface of each of the splines; a ratchet of cylindrical cross section having radially extending ratchet protuberances, each ratchet protuberance being configured to reside between adjacent splines, and each ratchet protuberance terminating at its top in a ramped surface in parallel with the ramped surface of each of the splines.

8. The switching apparatus of claim 1 wherein said contact cup comprises a metallic cylinder having an outwardly radiating lobe extending therefrom which is in contact with said second electrical terminal at said predefined rotational orientation.

9. A flat electrical switch comprising:

a housing defined by a top body portion, and a relatively thin bottom cover portion having an inner surface;

a first electrical terminal having a flat contact portion disposed on the inner surface of the bottom cover portion of said housing;

a second electrical terminal having a contact portion disposed within the top body portion of said housing;

an electrically conductive contact cup rotatably disposed within said housing in electrical contact with said second electrical terminal when the contact cup has a predefined rotational orientation, said contact cup having at least one recess provided therein;

an electrically conductive spring disposed between said conductive contact cup and the flat contact portion of said first electrical terminal, said spring maintaining electrical contact between the contact cup and the first electrical terminal;

a plunger slideably mounted in and projecting from said top body portion of said housing; and operating means disposed between said contact cup and said plunger for converting depression of said plunger into a preselected amount of rotation of said contact cup, said operating means further comprising at least one member couplable to said at least one recess in said contact cup to lock the operating means and contact cup together for converting depression of said plunger into a preselected amount of rotation of said contact cup.

10. The switching apparatus of claim 9 wherein said body portion and said cover portion are each comprised of an electrical insulating material.

11. A flat electrical switch comprising:

a housing defined by a top body portion, and a relatively thin bottom cover portion having an inner surface;

a first electrical terminal having a flat contact portion disposed on the inner surface of the bottom cover portion of said housing;

a second electrical terminal having a contact portion disposed within the top body portion of said housing;

an electrically conductive contact cup rotatably disposed within said housing in electrical contact with said second electrical terminal when the contact cup has a predefined rotational orientation, said contact cup having at least one recess provided therein;

an electrically conductive spring disposed between said conductive contact cup and the flat contact portion of said first electrical terminal, said spring maintaining electrical contact between the the contact cup and the first electrical terminal;

a plunger slideably mounted in and projecting from said top body portion of said housing and having a plurality of protuberances attached to and radiating radially outwardly therefrom; and operating means disposed between said contact cup and said plunger for converting depression of said plunger into a preselected amount of rotation of said contact cup, said operating means comprising a rotary ratchet mechanism including:

a plurality of splines in a cylindrical configuration arranged within the top portion of said housing, each spline terminating in a ramped surface angling downwardly and along the circumference of said cylindrical configuration at an angle of approximately 18°;

a ratchet of cylindrical cross section having radially extending ratchet protuberances, each ratchet protuberance being configured to reside between adjacent splines, and each ratchet protuberance terminating at its top in a ramped surface in parallel with the ramped surface of each of the splines, and wherein the plurality of plunger protuberances are configured to reside between adjacent splines, and each plunger protuberance terminates at its bottom in a ramped surface in parallel with the ramped surface of each of the splines; and at least one member couplable to said at least one recess in said contact cup to lock the operating means and contact cup together for converting depression of said plunger into a preselected amount of rotation of said contact cup.

12. A flat electrical switch comprising:

a housing defined by a top body portion, and a relatively thin bottom cover portion having an inner surface and a post extending therefrom toward the top body portion;

a first electrical terminal having a flat contact portion disposed on the inner surface of the bottom cover portion of said housing and extending substantially around the post;

a second electrical terminal having a contact portion disposed within the top body portion of said housing;

an electrically conductive contact cup rotatably disposed within said housing in electrical contact with said second electrical terminal when the contact cup has a predefined rotational orientation, said contact cup having at least one recess provided therein;

an electrically conductive spring disposed between said conductive contact cup and the flat contact portion of said first electrical terminal, said spring maintaining electrical contact between the the contact cup and the first electrical terminal;

a plunger slideably mounted in and projecting from said top body portion of said housing; and operating means disposed between said contact cup and said plunger for converting depression of said plunger into a preselected amount of rotation of said contact cup, said operating means further comprising at least one member couplable to said at least one recess in said contact cup to lock the operating means and contact cup together for converting depression o said plunger into a preselected amount of rotation of said contact cup.

13. A flat electrical switch comprising:

a housing defined by a top body portion, and a relatively thin bottom cover portion having an inner surface and a post extending therefrom toward the top body portion;

a first electrical terminal having a flat contact portion disposed on the inner surface of the bottom cover portion of said housing and extending substantially around the post;

a second electrical terminal having a contact portion disposed within the top body portion of said housing;

an electrically conductive contact cup rotatably disposed within said housing in electrical contact with said second electrical terminal when the contact cup has a predefined rotational orientation, said contact cup having at least one recess provided therein;

an electrically conductive spring disposed between said conductive contact cup and the flat contact portion of said first electrical terminal, said spring maintaining electrical contact between the the contact cup and the first electrical terminal;

a plunger slideably mounted in and projecting from said top body portion of said housing and having a plurality of plunger protuberances attached to and radiating radially outwardly therefrom; and operating means disposed between said contact cup and said plunger for converting depression of said plunger into a preselected amount of rotation of said contact cup, said operating means comprising a rotary ratchet mechanism including:

a plurality of splines in a cylindrical configuration arranged within the top portion of said housing, each spline terminating in a ramped surface angling downwardly and along the circumference of said cylindrical configuration at an angle of approximately 18°;

a ratchet of cylindrical cross section having radially extending ratchet protuberances, each ratchet protuberance being configured to reside between adjacent splines, and each ratchet protuberance terminating at its top in a ramped surface in parallel with the ramped surface of each of the splines, and wherein the plurality of plunger protuberances are configured to reside between adjacent splines, and each plunger protuberance terminates at its bottom in a ramped surface in parallel with the ramped surface of each of the splines; and at least one member couplable to said at least one recess in said contact cup to lock the operating means and contact cup together for converting depression of said plunger into a preselected amount of rotation of said contact cup.

* * * * *